US005232902A

United States Patent [19]

Takemura

[11] Patent Number: 5,232,902

[45] Date of Patent: Aug. 3, 1993

[54] METHOD AND APPARATUS FOR MODULATING RELATIVISTIC ELECTRON BEAMS TO PRODUCE MICROWAVES USING A SUPERCONDUCTING PASSAGE

[75] Inventor: Yasuhiko Takemura, Atsugi, Japan

[73] Assignee: Semiconductor Energy Laboratory Co., Ltd., Kanagawa, Japan

[21] Appl. No.: 668,126

[22] Filed: Mar. 12, 1991

[30] Foreign Application Priority Data

Mar. 26, 1990 [JP] Japan ..... 2-76310
Mar. 26, 1990 [JP] Japan ..... 2-76311
Mar. 27, 1990 [JP] Japan ..... 2-77783

[51] Int. Cl.[5] ..... H01J 25/02; H01B 12/02

[52] U.S. Cl. ..... 505/1; 505/700; 315/5; 315/39; 331/79

[58] Field of Search ..... 315/4, 5, 39; 331/79; 333/99 S; 332/179, 153, 165, 131, 137, 147; 505/1, 700

[56] References Cited

U.S. PATENT DOCUMENTS 2,914,736 11/1959 Young ..... 333/227 X
3,090,925 5/1963 Adler et al. ..... 332/131 X
3,441,881 4/1969 Weissman ..... 333/99 S
4,038,602 7/1977 Friedman ..... 315/5 X
4,215,291 7/1980 Friedman ..... 315/4 X
4,703,228 10/1987 West ..... 315/4 X
4,780,647 10/1988 Friedman et al. ..... 315/5 X
4,918,049 4/1990 Cohn ..... 333/227 X

*Primary Examiner*—Robert J. Pascal
*Assistant Examiner*—Benny T. Lee
*Attorney, Agent, or Firm*—Sixbey, Friedman, Leedom & Ferguson

[57] ABSTRACT

A method and an apparatus for enhancing modulation of a relativistic electron beam are described. A relativistic electron beam having been modulated is produced and passed through a superconducting passage having a periodicity in the passing direction of said beam. The periodicity is coincident with the modulation of the beam so that the modulation of the beam is enhanced by interaction between the beam and the superconducting passage through electromagnetic fields. The modulated electron beam can be used for generating microwaves at low power consumption.

22 Claims, 8 Drawing Sheets

FIG. 5(a) $^{t=0}$
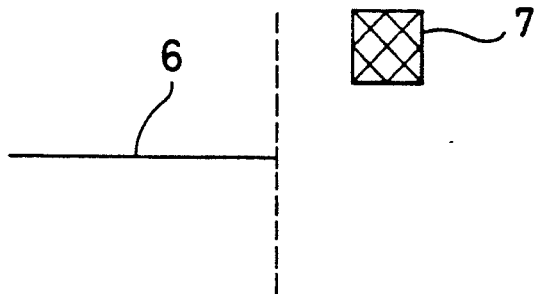
FIG. 5(b) $^{t=t_0}$
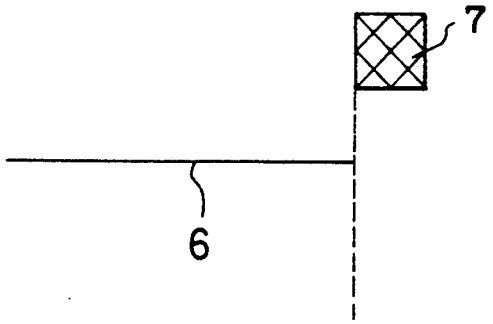
FIG. 5(c) $^{t=1.5t_0}$
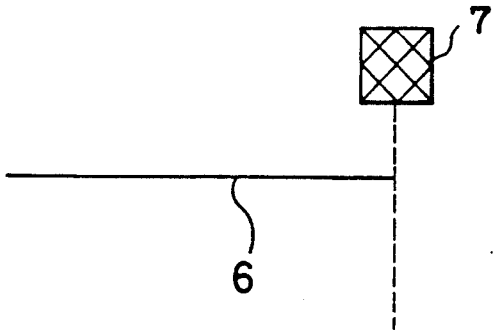

FIG. 5(d) $t=2t_0$
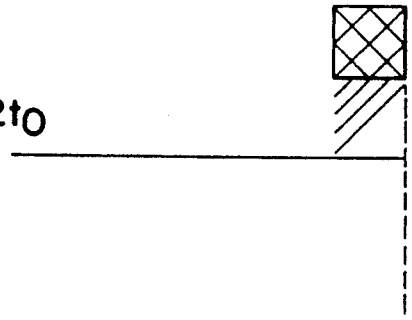
FIG. 5(e) $t=2.5t_0$
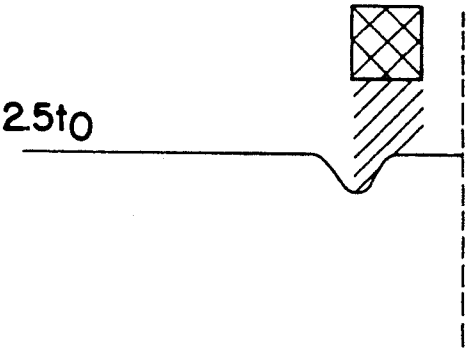
FIG. 5(f) $t=3t_0$
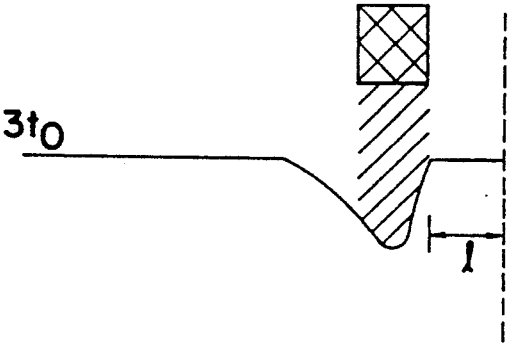

METHOD AND APPARATUS FOR MODULATING RELATIVISTIC ELECTRON BEAMS TO PRODUCE MICROWAVES USING A SUPERCONDUCTING PASSAGE

BACKGROUND OF THE INVENTION

1. Field of the Invention

The present invention relates to a method and an apparatus for generating relativistic electron beams.

2. Description of the Prior Art

Relativistic electron beams (simply called REB hereinafter) comprise electrons which move at relativistic velocities. REB has attracted interest of researchers because of applicability as a high energy beam for machining of articles having high melting points, plasma generation, microwave generation and so forth. One of the future applications of REB is generation of high power electromagnetic radiations such as free electron laser, X-ray lasers. Generation of X-ray laser beams can be expected by population inversion of multi-valent ions resulting from plasma recombination or electron collision. The pulse widths of REB currently available are as long as several nano seconds, which are not sufficiently short for X-ray lasers requiring quick excitation.

As for ultraviolet laser beams or visible laser beams, on the other hand, pulses can be easily obtained on the order of pico seconds by virtue of nonlinear optical effect. The X-ray laser resonance has been realized so far only by means of high power pulse lasers. Until now, ultra-short pulses of REB has not been considered since optical effect on non-linear electron beams is very weak.

On the other hand, research has been broadly carried out for generating microwaves by the use of REB. Microwaves are generated from an REB whose electron density is modulated to produce compression waves. The compression waves and therefore microwaves emitted therefrom are amplified by adjusting the velocity of the REB and the phase velocity of microwaves. Namely, the compression waves are amplified by electromagnetic fields of the microwaves. This mechanism has been broadly utilized in a variety of microwave resonators such as klystrons, travelling-wave tubes, magnetron. High density REB is desirable for microwave generation at high output power. The coulomb repulsion between electrons in REB, however, is very strong so that it is difficult to suppress dissipation of beams and to modulate the electron density of REB by electromagnetic fields of microwaves.

BRIEF SUMMARY OF THE INVENTION

It is an object of the present invention to provide a method and an apparatus for generating relativistic electron beams at lower power consumption.

It is another object of the present invention to provide a method and an apparatus for modulating relativistic electron beams.

It is a further object of the present invention to provide a method and an apparatus for generating very short pulses of relativistic electron beam.

It is a still further object of the present invention to provide a method and an apparatus for generating microwaves by utilizing relativistic electron beams.

Additional objects, advantages and novel features of the present invention will be set forth in the description which follows, and in part will become apparent to those skilled in the art upon examination of the following or may be learned by practice of the present invention. The object and advantages of the invention may be realized and attained by means of the instrumentalities and combinations particularly pointed out in the appended claims.

To achieve the foregoing and other object, and in accordance with the present invention, as embodied and broadly described herein, an REB is passed through a superconducting ring having a periodical geometry in the passage of the REB. A significant feature of superconductor materials is Meissner effect, in which the magnetic flux in a closed loop within a superconductor is kept constant. When a large current electron beam 2 is passed through a superconducting ring 1 as illustrated in FIG. 1 (Prior Art), the magnetic field induced by the electron beam 2 is squeezed by Meissner effect and the electron beam itself is compressed around the moving direction and becomes slender while elongated in the direction of motion. The compression force in the case of superconductivity of the first kind is in proportion to the square of the electric current of the beam, which can be ascertained by a simple calculation. The compression force in the case of superconductivity of the second kind is also approximately proportional to the square of the current, although this situation is rather complicated, when the current is in a usual range (no higher than 10 kA). Anyway, the electron beam 2 is made slender in cross section and expanded in the moving direction as illustrated.

The above discussion is explained on the assumption that the velocity of the electron beam is not so high and the interaction between the superconducting ring 1 and the beam 2 takes place without delay. This is correct only when the beam is sufficiently long as compared with the distance between the beam and the ring or the velocity of the beam is sufficiently low as compared with the velocity of light. The delay of the propagation of magnetoelectric fields, however, must be taken into consideration in the case of REB. For example, an electron is moving at half the velocity of light and passed first through a first position depicted by solid circle in FIG. 2. The rotating magnetic field around the electron at the first position is propagated at the velocity of light and reaches to the inner surface of the superconducting ring 3. An antiferromagnetic current (super-current) is induced at the surface and produces a repulsive magnetic field which is propagated toward the center of the ring. The electron, however, reaches to a second position depicted by open circle as shown in FIG. 2 when the repulsive magnetic field returns to the first position. Accordingly, the electron can be free of the magnetic field.

In the same situation, if a second electron reaches to the first position when the repulsive magnetic field comes back to the position, the electromagnetic force of the magnetic field is exerted upon the second electron instead of the first electron which has yielded the field. This phenomenon is utilized for modulating electron beams to produce compression waves in accordance with the present invention. This is explained more detailedly in conjunction with FIGS. 3(*a*) to 3(*c*). An electron beam slightly modulated enters a superconducting ring 4 at half the velocity of light as shown in FIG. 3(*a*). The modulation is adjusted in advance to coincide with the periodic cycle of the ring 4. The distance between the center of the beam and the ring 4 is selected to be half the wavelength of the modulated beam. The squeezing force exerted upon the beam is not uniform in the axial direction. The force is proportional to the square of the electric current as described above. In FIG. 3(*a*), the beam has an antinode at point A. The influence of the magnetic field induced by the antinode is reflected by the ring 4 and exerted upon the subsequent node of the beam at point A when the beam has advanced half the wavelength with the antinode being at point B as shown in FIG. 3(*b*). Namely, the strong squeezing force caused by the antinode is exerted upon the node so that the electric density at the node is further decreased by coulomb repulsive force. On the other hand, the influence of the magnetic field induced by the node is reflected by the ring 4 and exerted upon the subsequent antinode of the beam at point A when the beam has advanced another half of the wavelength in the same manner. The squeezing force caused by the node is, however, not so strong and therefore the modulation is effectively enhanced. The node is further squeezed again at point C when the beam has advanced a further half of the wavelength as shown in FIG. 3(*c*). When this action is sufficiently repeated, the electron beam becomes a square wave. Such a square wave contains many high frequency components. In particular, the frequency components y(t) of a square wave are given by:

$$y(t) = \Sigma \frac{1}{2n-1} \exp j(2n-1)\omega t$$

where $n = 0, 1, 2, \ldots, \omega$ is frequency, and $t$ is a unit of time.

where n=0, 1, 2, . . . , $\omega$ is frequency, and t is a unit of time.

By utilizing the modulated beam, high power electromagnetic waves can be generated at high frequencies corresponding to wavelengths no longer than one millimeter, which generation has not been realized by usual microwave resonators.

In accordance with another aspect of the present invention, an electron beam 8 is passed beside a superconducting body 7 in parallel as illustrated in FIG. 4. The beam 8 is deflected by the magnetic field induced by the superconducting body responsive to the magnetic field 9 induced by the beam 8 for the same reason as the modulated beam is squeezed as explained above. The deflecting force in the case of superconductivity of the first kind is in proportion to the square of the current, which can be ascertained by a simple calculation. The deflecting force in the case of superconductivity of the second kind is also approximately in proportion to the square of the current, which produces a complicated situation when the current is in a usual range (no higher than 10 kA). Anyway, the electron beam 8 is deflected apart from the body 7.

The above discussion is made on the assumption that the interaction between the superconducting body 7 and the beam 8 takes place without delay. The delay of magnetoelectric fields, however, must be taken into consideration in the case of REB. For example, an REB 6 is moving at the velocity of light, for example, toward the superconducting body 7 as shown in FIG. 5(*a*). This is accomplished by filling, with a dielectric material, the space between the superconducting body 7 and the REB except for the passage itself of the REB. The speed of the REB can be increased beyond the velocity of light in a dielectric material if desired. There is no interaction between the superconducting body and the electromagnetic field induced by the REB because the electromagnetic field can not advance beyond dashed line in the figure. This is the case until the REB reaches just adjacent to the superconducting body 7 as illustrated in FIG. 5(*b*). In FIG. 5(*c*), the superconducting body 7 makes contact and reacts with the electromagnetic field induced by the REB 6. The responsive electromagnetic field induced by the body 7 becomes exerted upon the REB after the head of the REB advances the distance between the REB and the body 7 as illustrated in FIG. 5(*d*). Thereafter, the subsequent portion of the REB is deflected as shown in FIGS. 5(*e*) and 5(*f*). Accordingly, the head portion of the REB having a length (=the distance l shown in FIG. 5(*f*) is separated from the subsequent portion and can alone be passed straightforward. In FIGS. 5(*d*) to 5(*f*), the dashed lines designate the responsive magnetic field propagated from the body 7. In the case that the distance is 1 mm, the separated head has a pulse width of 3 pico second. The shorter limit upon the pulse widths obtained may be 1 pico second or therearound, at this time, because of the delay time of the response of the superconductor to an arrival electromagnetic field.

BRIEF DESCRIPTION OF THE DRAWINGS

The accompanying drawings, which are incorporated in and form a part of the invention and, together with the description, serve to explain the principles of the invention.

FIGS. 5(*a*) to 5(*f*) are schematic diagrams showing the mechanism of cutting the head portion of an REB in accordance with the present invention, respectively at times t=0, t=to, $t=1.5t_o$, $t=2t_o$, $t=2.5t_o$ and $t=3t_o$, where $t_o=l/c$ (l is the distance between the REB and the superconducting body; c is the velocity of light).

DETAILED DESCRIPTION OF THE PREFERRED EMBODIMENTS

Figure 6:
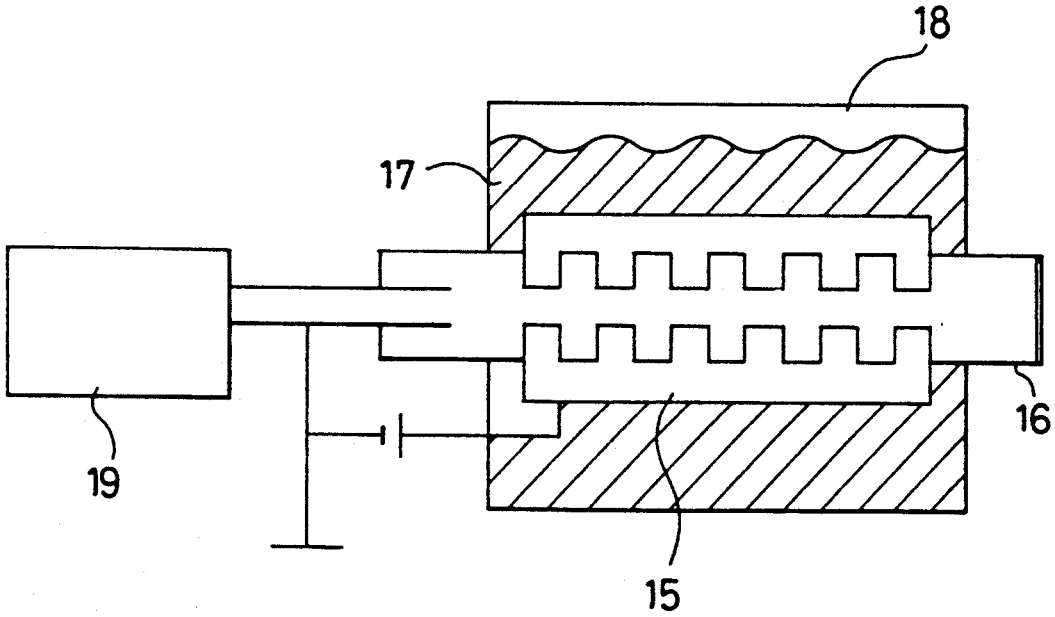
FIG. 6 is a schematic view showing an apparatus for enhancing modulation of REB in accordance with the present invention.

Referring now to FIG. 6, an apparatus for generating REB in accordance with an embodiment of the present invention will be explained. The apparatus comprises a superconducting modulation cylinder 15 hermetically disposed in a heat insulating container 18, a linear electron accelerator 19 coupled with the cylinder 15 in order to emit high energy electrons into the cylinder 15. The container 18 holds the cylinder 15 in an air-tight manner and the inside of the cylinder 15 is filled with an inert gas such as neon at 0.15 Torr. The interaction between electrons and the dispersion thereof can be lessened by the existence of neon. The cylinder 15 is made from silver and formed with circular inner projections in its inner surface. The projections are periodically arranged a predetermined distance apart from each other in accordance with the principle as discussed above. The inner surface of the cylinder 15 is coated with a superconducting film made from an oxide ceramic in the form of $YBa_2Cu_3O_{7-X}$, the critical temperature of which is more than liquid nitrogen temperature. The superconducting oxide may be deposited by chemical vapor reaction to a thickness of about 10 μm. The film can be coated only on the inner ends of the projections instead of the whole inner surface. When the apparatus is operated, liquid nitrogen 17 has to be disposed in advance between the container 18 and the cylinder 15 in order to render the oxide film superconducting.

In operation, the accelerator 19 emits a slightly modulated REB whose wavelength and velocity are selected in order to synchronize with the periodicity of the superconducting inner surface during propagation of the beam as explained above. The REB is accelerated to 170 KeV by means of the voltage source connected between the accelerator 19 and the cylinder 15. In accordance with experiments, it was confirmed that REB having passed through the cylinder 15 was strongly modulated as compared with that before the entrance of the beam into the cylinder 15 by examining radiation produced when the REB collided with a solid scintillator 16. Such compression waves of REB can be utilized in many applications. For example, when used in machining of articles having high melting points, the high energy output at the leading head facilitates the machining action as compared with conventional methods. This machining is particularly suitable for such as cutting and boring of relatively large articles rather than fine machining because the focus limit of REB is several millimeters.

Figure 7:
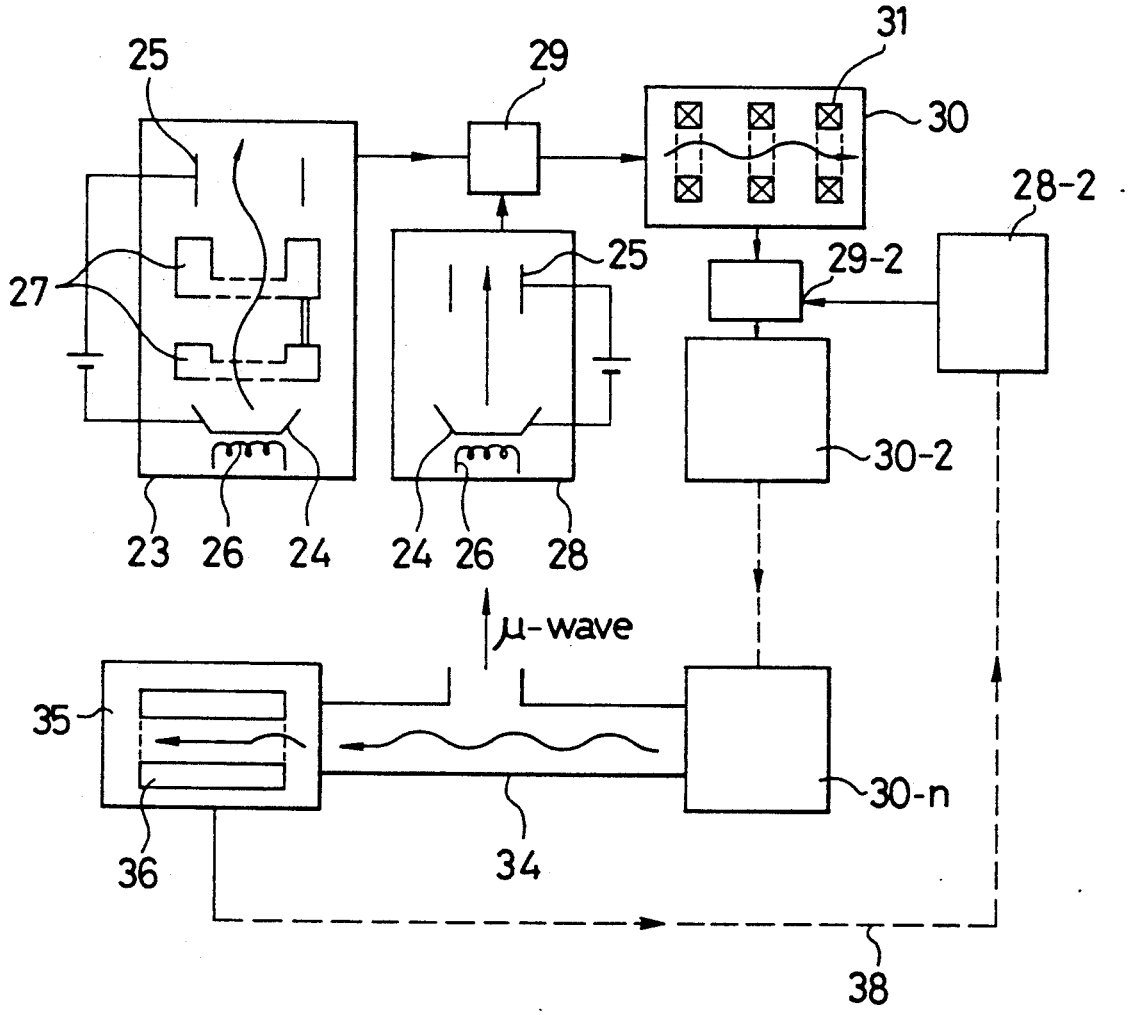
FIG. 7 is a schematic view showing an apparatus for generating microwaves utilizing modulated REB in accordance with the present invention.

FIG. 7 is a block diagram showing a microwave generator utilizing REB modulated in accordance with the principle of the present invention as described above. The generator includes a klystron 23 provided with a cathode 24, an anode 25, a heater 26 for heating the cathode 24 and emitting REB toward the anode 25, and a resonating space 27 formed between the cathode 24 and the anode 25 for modulating the REB. The REB emitted from the klystron 23 is transmitted to a first stage amplifier composed of a klystron 28 also comprising a cathode 24, an anode 25 and a heater 26, a mixer 29 and a modulator 30 containing a plurality of superconducting rings 31 spaced by a predetermined distance from each other in correspondence with the modulation of the REB passing therethrough. A plurality of amplifier systems are provided in the subsequent stages of the first stage of amplification, each comprising a klystron, a mixer and a modulator, in the same manner as the first amplifier, for example, as depicted by numerals 28-2, 29-2 and 30-2. The final amplifier is connected to a microwave oscillating cylinder 34 for microwave generation which terminates in a converter 35.

In the operation of the generator, the klystron 23 generates and transmits a slightly modulated REB to the mixer 29. The klystron 28, on the other hand, generates another REB of DC current which is mixed with the modulated REB emitted from the klystron 23 in the mixer 29. Accordingly, the modulation of the REB is lessened by the mixing while the strength of the beam is amplified. The modulation of the mixed REB is then enhanced by the modulator 30. The mixing and the modulation are repeated in the second stage amplifier composed of the klystron 28-2, the mixer 29-2 and the modulator 30-2, and also in the subsequent amplifiers. The final modulator 30-n emits a high power REB into the cylinder 34 in which the REB produces high power and high frequency microwaves. After emission of the microwaves, the REB is rectified into a DC REB by passing through a straight superconducting cylinder 36 in the converter 35. Namely, the REB is subjected to a uniform squeezing pressure and the compression wave therein disappears. The DC REB is then fed back via an REB feedback line 38 to the respective klystrons of the amplification stages to utilize the REB thus fed back for amplification. Throughout the system, the energy of electrons in the REB is kept at 170 keV, which corresponds to half the velocity of light.

The recycle of REB is particularly desirable because, in conventional devices, electron beams are left dissipating and therefore the temperature of the system is elevated beyond a tolerable level so that there must be provided a particular cooling means. Of course, the energy efficiency in generation of microwaves is substantially improved by the recycle.

By employment of the feedback system, no particular cooling device is necessary and continuing oscillation becomes possible at 10 MW. Also, the oscillation efficiency can be substantially improved to 50% or higher. Such high power continuous oscillation is appropriate for energizing particle accelerators, microwave transmission, heating plasmas in nuclear fusion and so forth.

Figure 8:
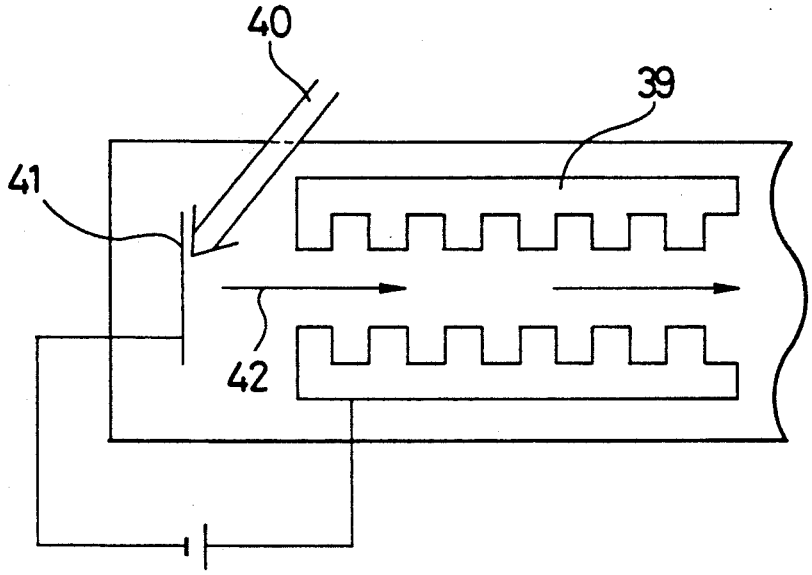
FIG. 8 is a schematic view showing another apparatus for enhancing modulation of REB in accordance with the present invention.

FIG. 8 is a schematic diagram showing another example of the method for generating modulated REB. Laser pulses 40 modulated at 2 GHz are directed at a metallic target 41 to produce an REB 42 including high frequency components corresponding to the modulation of the pulse 40. The REB 42 is accelerated to 170 KeV by means of a voltage source connected between the target 41 and a periodical superconducting cylinder 39 and passed for modulation through the periodical superconducting cylinder 39 which has a plurality of projections at its inner surface cooled by liquid nitrogen. The projections are periodically arranged a predetermined distance apart from each other in accordance with the principle as discussed above. The inner surface of the cylinder 39 is coated with a superconducting film made from an oxide ceramic in the form of $YBa_2Cu_3O_{7-X}$, the critical temperature of which is more than liquid nitrogen temperature. The superconducting oxide may be deposited by chemical vapor reaction to a thickness of about 10 μm. The modulated REB passing through the cylinder 39 is amplified by an amplifier of the same type of the first stage amplifier in FIG. 7. In accordance with experiments, high frequency microwaves were obtained at 10 KW from the REB thus modulated twice. The output can be increased by the use of more stages of amplifiers.

Figure 9:
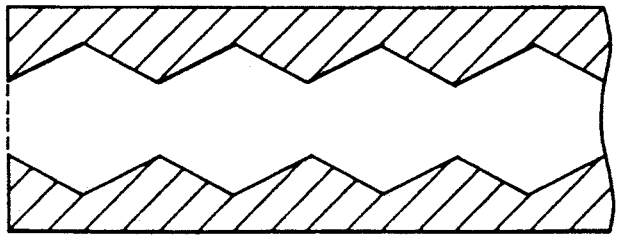
FIG. 9 is a schematic view showing a superconducting modulator in accordance with the present invention.

In the above description, the superconducting cylinder for modulation can take other configurations as long as periodical influence can be given to REB. When a superconducting film is coated on the inner surface of the cylinder, the thickness of the film has to be larger than the penetration of the magnetic field. FIG. 9 illustrates one example of such suitable configurations by molding suitable material such as a metal, a ceramic, a polymer in a form having a periodical inner surface as shown in FIG. 9 and coating the inner surface with a superconducting material to a thickness of several micrometers or less.

Figure 1:
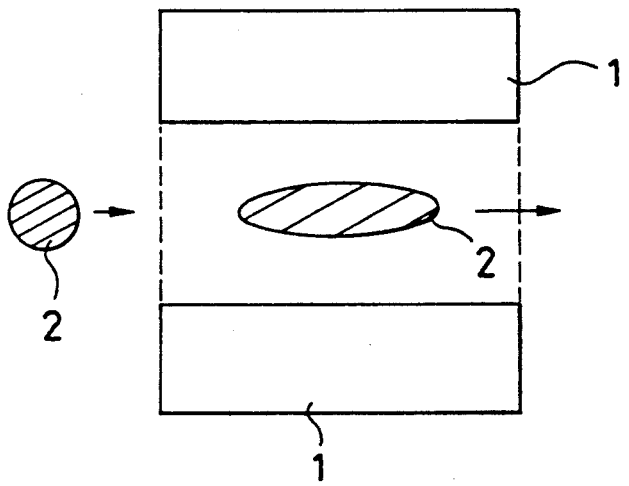
FIG. 1 PRIOR ART
FIG. 1 is an explanatory view demonstrating effect of a prior art superconducting ring upon an electron beam.
Figure 2:
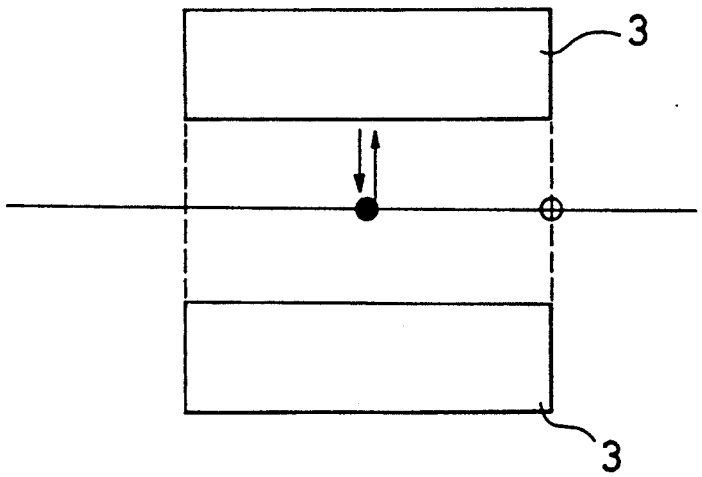
FIG. 2 is an explanatory view for demonstrating effect of a superconducting ring upon relativistic electrons.
Figure 3A:
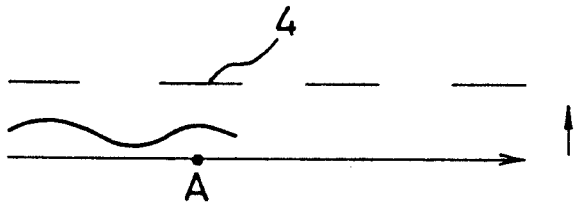
FIGS. 3(*a*) to 3(*c*) are schematic diagrams showing the mechanism of enhancing modulation of an REB in accordance with the present invention.
Figure 3B:
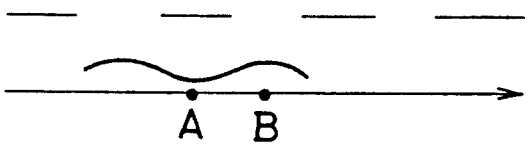
Figure 3C:
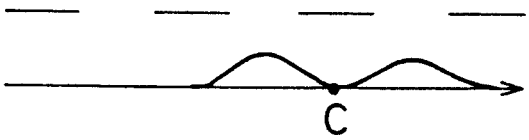
Figure 4:
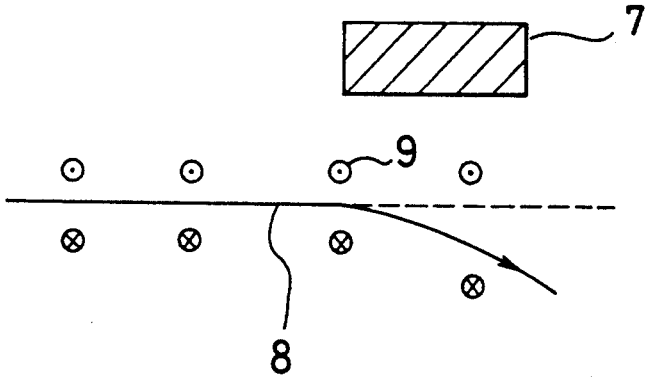
FIG. 4 is an explanatory view demonstrating effect of a superconducting body upon an electron beam passing through thereaside.
Figure 10:
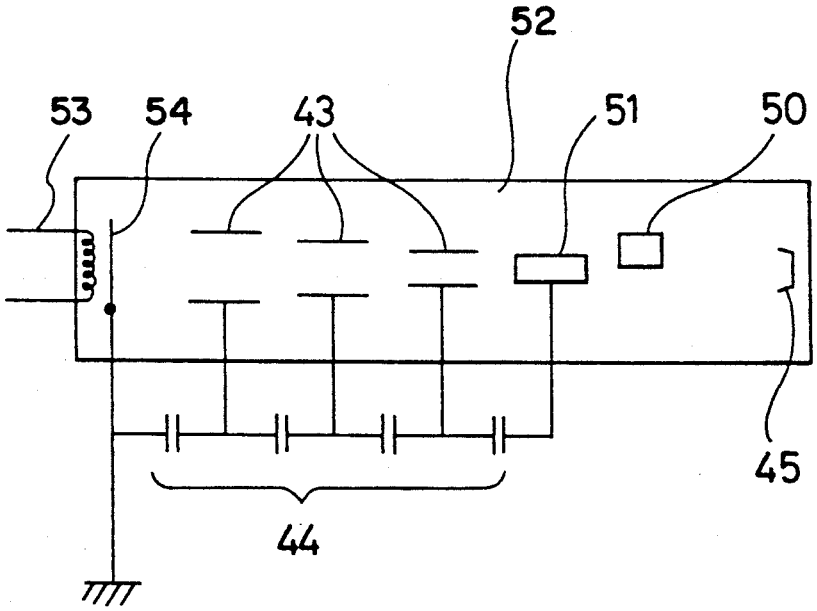
FIG. 10 is a schematic diagram showing an apparatus for cutting the head portion of an REB in accordance with the present invention.

The similar mechanism can be utilized to produce a very short REB pulse as already explained in conjunction with FIG. 4 and FIGS. 5(*a*) to 5(*f*). Referring now to FIG. 10, an apparatus for generating a short pulse of REB in accordance with the present invention will be explained. The apparatus comprises a vacuum vessel 52, a heater 53, a cathode 54, a plurality of anodes 43, a superconducting cylinder 51 of 10 mm diameter made from an oxide ceramic of $YBa_2Cu_3O_{7-X}$, a deflector 50 and a Faraday cup 45. The inside of the vessel 52 is filled with an inert gas such as neon at 0.15 Torr in order not to invoke unwanted coulomb repulsion among electrons. The cathode 54, the anodes 43 and the cylinder 51 are coaxially arranged and provided with capacitors 44 to be charged in order to accelerate electron beams passing therethrough to 170 KeV by virtue of high differential voltages therebetween. The deflector 50 is a rectangular parallelepiped (2 mm×2 mm×5 mm) made from an oxide ceramic of $YBa_2Cu_3O_{7-X}$ and embedded in a dielectric body having a relative dielectric constant of 2 and arranged in order that electrons passing through the cylinder 51 can be passed just adjacent to the rectangular deflector 50. The rectangular deflector 50 is coated with the dielectric material of the body to a thickness of 1 mm at the side beside which electrons are passed.

In the operation, electrons are emitted from the cathode 54 heated by means of the heater 53 and accelerated through the anodes 43 and the cylinder 51, in which the electrons are formed into a REB of 1 mm diameter and 10 nano second beam length. The REB is then passed near the deflector 50 in parallel only with 1 mm or therearound in distance and deflected in the direction apart from the deflector 50 except for a head portion thereof. The non-deflected head portion is a very short pulse of the REB having a pulse width of about 10 pico second and an energy of 170 KeV. The current of the pulse is up to 10 kA. The electrons of the pulse are collected by the Faraday cup 45 and analyzed in terms of time. Of course, a solid scintilator can be used instead to analyze the electron pulse by taking a picture of radiation from the scintilator by a streak camera. REB pulses of such high power level and short pulse widths are usable for example in X-ray laser resonance, inertial confinement nuclear fusion and machining at lower temperatures.

The foregoing description of preferred embodiments has been presented for purposes of illustration and description. It is not intended to be exhaustive or to limit the invention to the precise form described, and obviously many modifications and variations are possible in light of the above teaching. The embodiment was chosen in order to explain most clearly the principles of the invention and its practical application thereby to enable others in the art to utilize most effectively the invention in various embodiments and with various modifications as are suited to the particular use contemplated.

What is claimed is:

1. A method of enhancing modulation of a relativistic electron beam comprising:

producing a relativistic electron beam and modulating the beam with a defined modulation period; and passing said beam in a defined direction through a superconducting passage having a structural periodicity in said direction of said beam, said periodicity coinciding with the period of modulation of said beam, whereby modulation of said beam is enhanced.

2. The method of enhancing modulation of a relativistic electron beam of claim 1, comprising the further preliminary step of providing said superconducting passage having a structural periodicity, said passage comprising a hollow cylinder having an inner surface, said inner surface coated with a superconducting material.

3. The method of enhancing modulation of a relativistic electron beam of claim 2, wherein in the step of providing said superconducting passage, said inner surface is provided with a plurality of circular projections apart from each other in accordance with said periodicity.

4. An apparatus for enhancing modulation of a relativistic electron beam comprising:

a means for producing a relativistic electron beam and modulating said beam with a defined modulation period; and a superconducting passage associated with said beam producing means and arranged proximate thereto so that said electron beam from said beam producing means passes therethrough in a defined direction, said superconducting passage having a structural periodicity in said direction of said beam, said periodicity coinciding with the modulation period of said beam, thereby enhancing modulation of said beam.

5. The apparatus for enhancing modulation of a relativistic electron beam of claim 4, wherein said passage comprises a cylinder having an inner surface, said inner surface coated with a superconducting material.

6. The apparatus for enhancing modulation of a relativistic electron beam of claim 5, wherein said inner surface is provided with a plurality of circular projections spaced apart from each other in accordance with said periodicity.

7. The apparatus for enhancing modulation of a relativistic electron beam of claim 4 wherein said beam producing means comprises a klystron for producing said beam.

8. The apparatus for enhancing modulation of a relativistic electron beam of claim 4 wherein said beam producing means comprises an electron accelerator for generating said beam.

9. The apparatus for enhancing modulation of a relativistic electron beam of claim 4 wherein said beam producing means comprises a photoelectron generating device which produces said modulated beam by irradiating a metallic plate with laser pulses in accordance with said periodicity.

10. A method of generating microwaves comprising the steps of:

producing a relativistic electron beam and modulating said beam with a defined modulation period; and enhancing modulation of said relativistic electron beam by passing said beam in a defined direction through a superconducting passage having a structural periodicity in said direction of said beam, said periodicity being coincident with the period of modulation of said beam; and connecting a microwave emitting apparatus to said beam whose modulation has been enhanced by said enhancing step to thereby produce microwaves from said beam.

11. The method of generating microwaves of claim 10 further comprising the step of mixing said beam whose modulation has been enhanced with a second relativistic electron beam to produce a mixed beam; and the additional step of enhancing modulation of said mixed beam by passing said mixed beam in a defined direction through a superconducting passage having a structural periodicity in said direction of said mixed beam, said periodicity being coincident with the period of modulation of the mixed beam.

12. The method of generating microwaves of claim 11 wherein in said mixing step said second relativistic electron beam mixed with said modulation enhanced beam is an unmodulated beam.

13. The method of generating microwaves of claim 11 comprising the further step of repeating said mixing and mixed beam enhancing steps at least once prior to production of microwaves from said beams.

14. The method of generating microwaves of claim 10 including the further preliminary step of providing said superconducting passage having a structural periodicity in the direction of the beam, said passage comprising a cylinder having an inner surface, said inner surface coated with a superconducting material.

15. The method of generating microwaves of claim 14 wherein in the step of providing said superconducting passage, said inner surface is provided with a plurality of circular projections spaced apart from each other in accordance with said periodicity.

16. An apparatus for generating microwaves comprising:

a means for producing a relativistic electron beam and modulating said beam to produce an output beam with a defined modulation period;

enhancing means associated with said beam producing means and positioned proximate thereto in a position to receive said beam from said beam producing means, for enhancing modulation of said relativistic electron beam by passing said beam in a defined direction through a superconducting passage having a structural periodicity in said direction of said beam, said periodicity being coincident with said modulation period of said beam; and a means for causing emission of microwaves from said beam whose modulation has been enhanced, said means connected to receive said beam from said enhancing means and operating in response to said beam output of said enhancing means.

17. The apparatus for generating microwaves of claim 16 further comprising second beam producing means for producing a second relativistic electron beam, a mixer coupled with said enhancing means and said second beam producing means for mixing said beam whose modulation has been enhanced by said enhancing means with said second beam produced by said second beam producing means to produce a mixed beam, and second enhancement means connected to said mixer to receive said mixed beam output of said mixer, for enhancing modulation of the mixed beam and providing said mixed beam to said emission causing means.

18. The apparatus for generating microwaves of claim 16 wherein said passage comprises a cylinder having an inner surface, said inner surface coated with a superconducting material.

19. The apparatus for generating microwaves of claim 18 wherein said inner surface is provided with a plurality of circular projections spaced apart from each other in accordance with said periodicity.

20. The apparatus for generating microwaves of claim 16 wherein said beam producing means comprises a klystron for generating said beam.

21. The apparatus for generating microwaves of claim 16 wherein said beam producing means comprises an electron accelerator for generating said beam.

22. The apparatus for generating microwaves of claim 16 wherein said beams producing means comprises a photoelectron generating device which produces said modulated beam by irradiating a metallic plate with laser pulses in accordance with said periodicity.

* * * * *